United States Patent [19]

Guichon

[11] Patent Number: 4,792,181

[45] Date of Patent: Dec. 20, 1988

[54] FOLDABLE ARMCHAIR WITH ADJUSTABLE BACKREST AND FOOTREST

[75] Inventor: Jean-Paul Guichon, Pratz, France

[73] Assignee: Grosfillex S.A.R.L., Oyonnax, France

[21] Appl. No.: 78,672

[22] Filed: Jul. 28, 1987

[30] Foreign Application Priority Data

Aug. 7, 1986 [FR] France ..... 86 11604

[51] Int. Cl.[4] ..... A47C 4/00

[52] U.S. Cl. ..... 297/28; 297/30; 297/68; 297/90

[58] Field of Search ..... 297/28, 29, 30, 90, 297/68

[56] References Cited

U.S. PATENT DOCUMENTS 238,896 3/1881 Harding ..... 297/90
774,776 11/1904 Perry ..... 297/90
1,114,155 10/1914 Laskowski ..... 297/28

FOREIGN PATENT DOCUMENTS 1941702 2/1971 Fed. Rep. of Germany ..... 297/28
819344 9/1959 United Kingdom ..... 297/28

*Primary Examiner*—Francis K. Zugel
*Attorney, Agent, or Firm*—Dowell & Dowell

[57] ABSTRACT

This invention relates to a foldable armchair incorporating adjustable backrest and footrest, in which the connecting elements which control orientation of the footrest are connected to the backrest by pivoting crank pins provided with bearing faces cooperating with stops on said backrest, so as to make a unidirectional angular connection which ensures modification of the orientation of the footrest during any angular modification of the backrest, while allowing the armchair to be completely folded.

5 Claims, 4 Drawing Sheets

FOLDABLE ARMCHAIR WITH ADJUSTABLE BACKREST AND FOOTREST

BACKGROUND OF THE INVENTION

Field of the Invention

The present invention relates to armchairs, particularly for use in the open air, in which the footrest, pivotally attached to the front edge of the seat, is connected to the backrest articulated on the legs, so that any modification of the inclination of the backrest brings about a corresponding modification of the inclination of the footrest.

SUMMARY OF THE INVENTION

It is an object of the invention to produce an armchair of the type set forth hereinabove which, while being of simple and rugged construction, is capable of being folded into small dimensions for transport, storage or stowing.

The armchair of the invention is essentially noteworthy in that the rear end of each of the longitudinal connecting elements which, in conventional manner, connect the backrest and the footrest, is articulated on a pivoting crank pin which is angularly connected or abutted to said backrest only in one direction of rotation so as to remain free to pivot in the opposite direction when the whole of the chair is folded.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
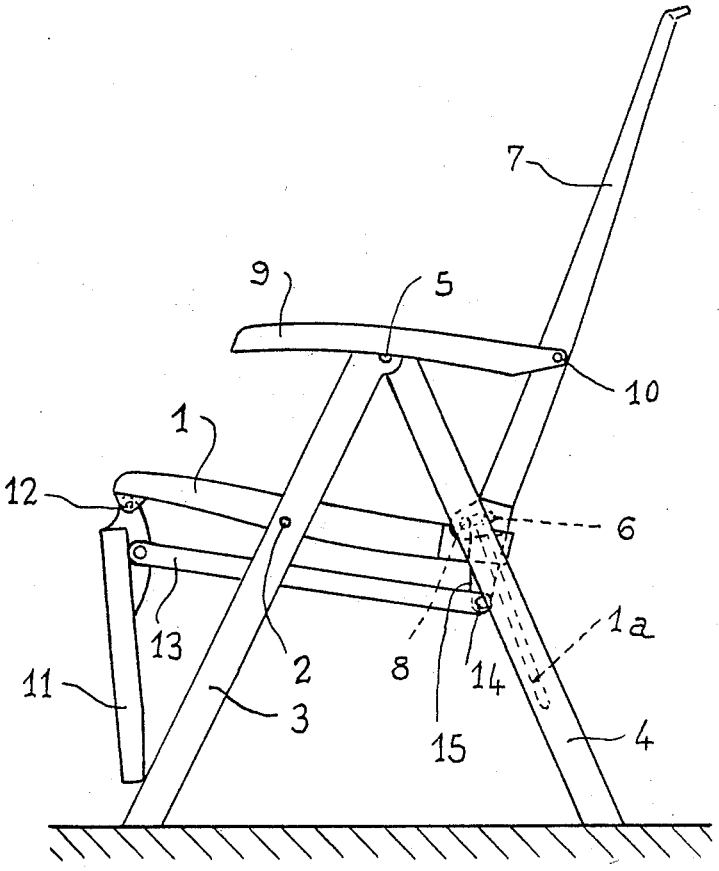
FIG. 1 is a side view of an armchair according to the invention, shown in the position where its backrest is most upright.

Referring now to the drawings, reference 1 designates the seat of the armchair of which the edges are articulated at 2 on the front legs 3 which are pivotally assembled at 5 on the rear legs 4 in order to define a foldable support formed by two braced lateral legs in the form of a downwardly open V. On the rear, narrowed part of the seat 1 is articulated at 6 (cf. FIG. 4), the base 7' of the inclinable backrest 7 which is supported by the rear legs 4 by means of two projecting pins 8 (shown in FIG. 4 in the form of simple lines of axis) slidably engaged in slideways 4*a*. The slideways are made longitudinally in the inner wall of the rear legs 4, each slideway 4*a* presenting at its upper end a transverse step for retaining the corresponding pin 8 and for holding the seat 1 in substantially horizontal position, while allowing the armchair to be folded.

Adjustment of the inclination of the backrest 7 and immobilization thereof at the chosen inclination are effected by means of two armrests 9 articulated at 10 on said backrest 7. The downwardly turned face of each armrest 9 comprises a rack toothing adapted to cooperate selectively with a fixed tooth provided on one or the other of the legs 3 or 4, above the pivot 5.

This arrangement is well known in practice and, in addition, has been described in detail in Applicant's French patent application No. 86 04634 filed on Mar. 26, 1986.

The armchair also comprises a footrest 11 pivotally attached at 12 to the front edge of the seat 1. Two longitudinal connection elements 13 connect this footrest 11 to the backrest 7 so that any modification of the inclination of the latter causes tipping of the footrest which, in the most upright position of the backrest (FIG. 1), is folded vertically beneath the seat 1, while, in the inclined position of FIG. 2, it is raised in line with the seat. The connecting elements 13 must, in addition, make it possible to fold the whole of the armchair to reduced dimensions (cf. FIG. 5), with the footrest 11 brought parallel to the seat 1.

Figure 3:
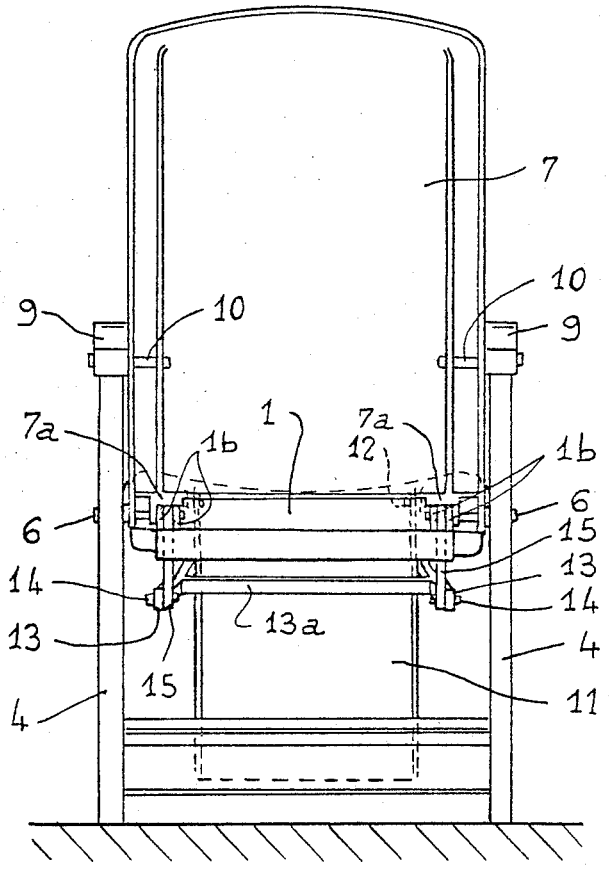
FIG. 3 is a view in elevation of the armchair from the rear.
Figure 4:
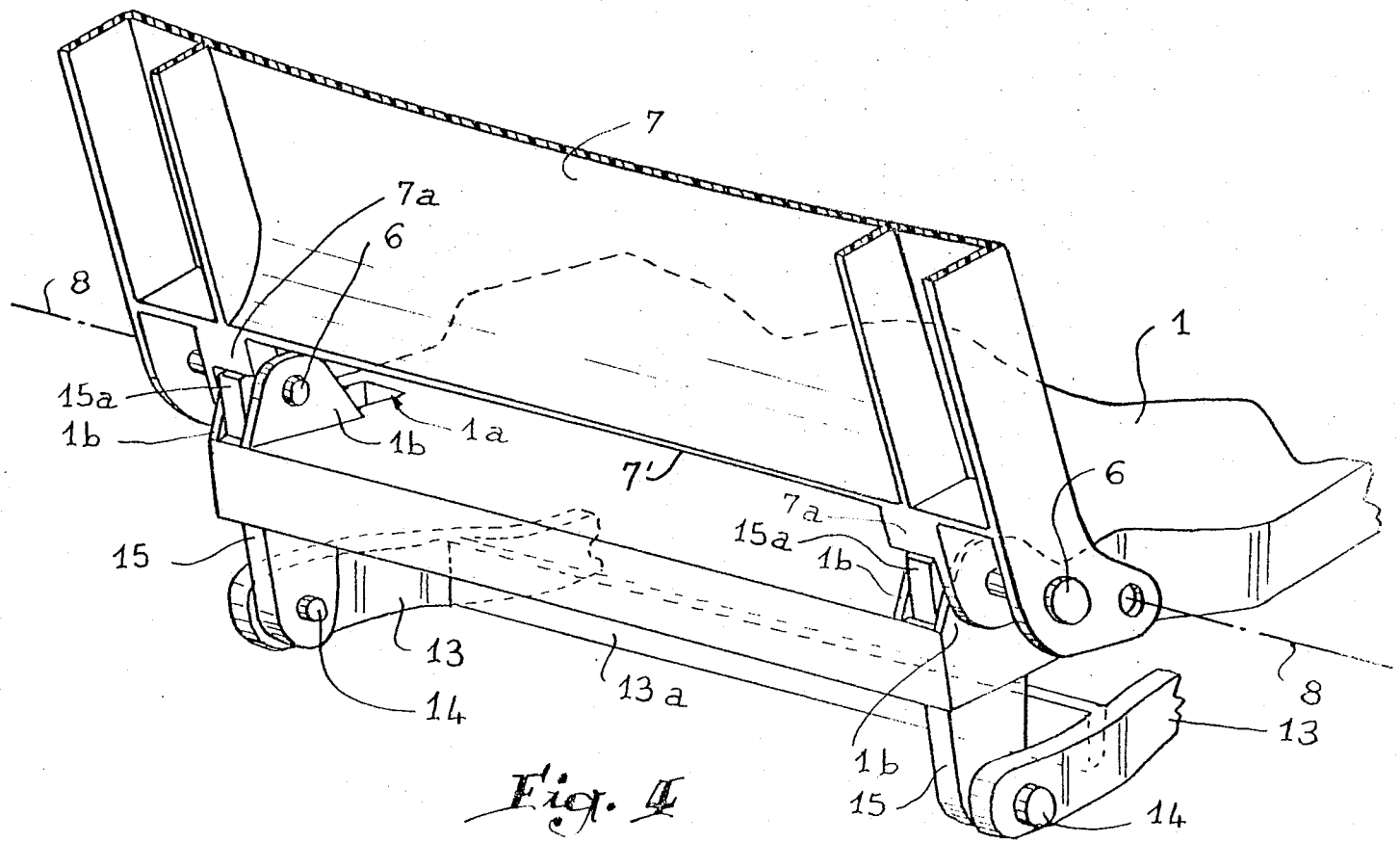
FIG. 4 is a view in perspective, on a larger scale, showing the rear part of the armchair at the level of the articulated connection provided between the backrest and the seat.

To this end and as shown more particularly in FIGS. 3 and 4, the rear end of each connecting element 13, which is connected to the opposite connecting element by a crosspiece 13*a*, is pivotally assembled at 14 on a crank pin 15. On the embodiment envisaged, the crank pin traverses a slot 1*a* in the seat 1 to articulate on the corresponding pivot 6, between the two lugs 1*b* of the seat which support this pivot. Each crank pin 15 is sectioned to present a support or bearing face 15*a* adapted to cooperate with an upper stop 7*a* provided on the backrest 7.

In order to explain the operation of the armchair, the upright position illustrated in FIG. 1 will be the starting point. It will be understood that, when, by suitably maneuvering the immobilizing armrests 9, the user wishes to bring the armchair into the inclined position of FIG. 2 or to an intermediate position, rearward pivoting of the backrest 7 causes, by action of the stops 7*a* against the bearing faces 15*a*, actuation of the connecting elements 13 which therefore progressively raise the footrest 11.

Figure 2:
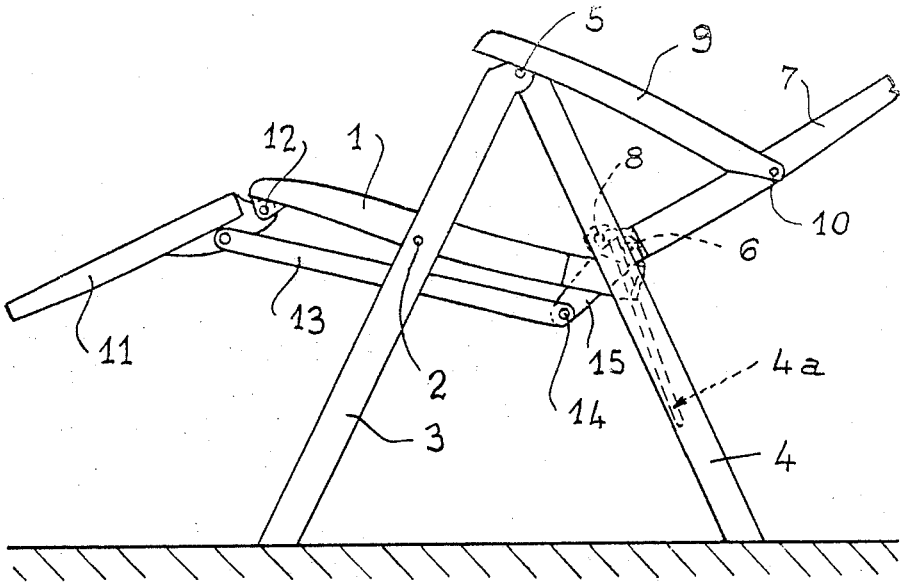
FIG. 2 reproduces FIG. 1, in the most inclined position of the backrest.

When, on the other hand, it is desired to return the armchair from the inclined position of FIG. 2 to the upright position of FIG. 1 or to any intermediate position, there is obviously no more positive action of the backrest 7 on the connecting elements 13, but the bearing faces 15*a* remain in contact with the stops 7*a* due to the weight in overhang of the footrest 11 which is exerted on the connecting elements 13. The footrest 11 therefore follows, to some extent, by progressive downward folding, the straightening up of the backrest 7.

Figure 5:
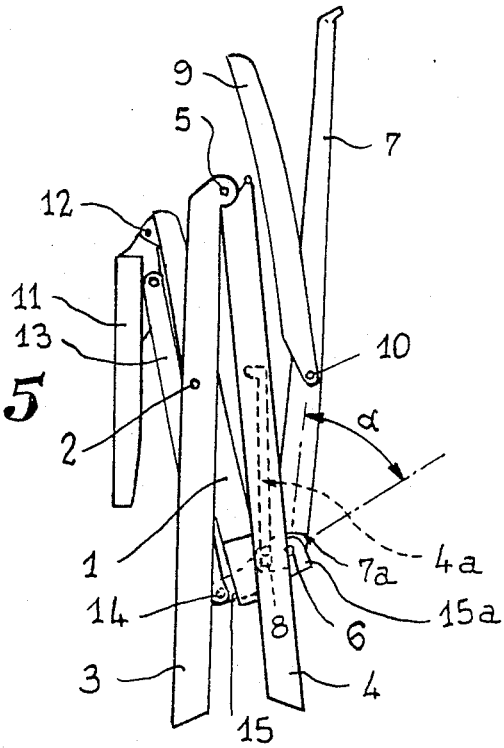
FIG. 5 is a side view similar to those of FIGS. 1 and 2, but showing the armchair being folded.

The unidirectional angular connection or abutment existing between the crank pins 15 and the backrest 7 and consequently between the backrest and the footrest 11, further allows the armchair to be folded in the manner illustrated in FIG. 5. In fact, during such folding, the crank pins 15, until then oriented substantially in line with the backrest 7, are free to pivot (angle $\alpha$) to be oriented substantially perpendicularly to the seat 1 and to the backrest 7, thus allowing the connecting elements 13 to move back and the footrest 11 to fold down completely. The footrest consequently being oriented parallel to the other elements of the armchair.

The construction according to the invention and use thereof are much simplified with respect to the known arrangements which most often employ telescopic or sliding systems provided with a manual locking mechanism. The system according to the invention is totally reliable.

It will be understood that the assembly of the crank pins 15 and actuation thereof by the backrest 7 in one direction of pivoting may differ from those envisaged hereinabove, as long as a unidirectional angular connection is obtained.

It must, moreover, be understood that the foregoing description has been given only by way of example and that it in no way limits the domain of the invention which would not be exceeded by replacing the details of execution described by any other equivalents.

What is claimed is:

1. A foldable armchair including adjustable backrest and footrest which are pivotally connected to the forward and rear portions of a seat so as to be extendable from and collapsible with respect thereto in which the improvement comprises, a pair of spaced longitudinally connecting elements disposed beneath the seat and extending generally between the forward and rear portions thereof, said connecting elements having front and rear ends, first pivot means for pivotally connecting said first ends of said connecting elements to said footrest, a pair of crank means having upper and lower ends, second pivot means for pivotally connecting said lower end of said crank means to said rear ends of said connecting elements, the backrest having upper and base portions, third pivot means for pivotally connecting said crank means to the seat adjacent the rear portion thereof and to the backrest adjacent the base portion thereof, a pair of spaced stop means formed along and extending from and in substantial alignment with said base portion of the backrest, said upper ends of each of said crank means including a bearing surface face which is selectively engageable with said pair of spaced stop means of the backrest, said bearing surface faces having a configuration so as to be drivingly engaged by said stop means when the backrest is pivoted to extend away from the seat but which permits the free rotational movement of the backrest when the backrest is pivoted so as to be collapsible with respect to the seat.

2. The foldable armchair of claim 1 in which the seat includes a pair of spaced openings therethrough adjacent the rear portion thereof, said crank means being extended through said openings, said third pivot means including two pairs of spaced opposing flanges which are joined to the seat and two pairs of downwardly extending opposing flanges which extend from said base portion of the backrest, and pin means extending through said upper ends of said crank means and said opposing flanges joined to the seat and said opposing flanges of the backrest.

3. The foldable armchair of claim 2 including cross-piece means disposed beneath the seat and connected to join each of the connecting elements adjacent said rear ends thereof.

4. The foldable armchair of claim 2 in which said connecting elements and said crank means may be selectively articulated with respect to oneanother and the backrest and footrest so that the backrest, footrest and connecting elements are selectively foldable into generally parallel relationship with one another with said crank means extending generally perpendicularly with respect thereto.

5. A foldable armchair including adjustable backrest and footrest which are pivotally connected to the forward and rear portions of a seat so as to be extendable from and collapsible with respect thereto in which the improvement comprises, a pair of spaced longitudinally connecting elements disposed beneath the seat and extending generally between the forward and rear portions thereof, said connecting elements having front and rear ends, first pivot means for pivotally connecting said first ends of said connecting elements to said footrest, a pair of crank means having upper and lower ends, second pivot means for pivotally connecting said lower end of said crank means to said rear ends of said connecting elements, third pivot means for pivotally connecting said crank means to the seat adjacent the rear portion thereof, the backrest having upper and lower portions, stop means formed along said lower portion of the backrest, said upper ends of each of said crank means forming shaped bearing surfaces which are selectively engageable with said stop means of the backrest, said bearing surfaces having a configuration so as to be drivingly engaged by said stop means when the backrest is pivoted to extend away from the seat but which permits the free rotational movement of the backrest when the backrest is pivoted so as to be collapsible with respect to the seat, the seat including a pair of spaced openings therethrough adjacent the rear portion thereof, said crank means being extended through said openings, said third pivot means including two pairs of spaced opposing flanges which are joined to the seat, and pin means extending through said upper ends of said crank means and said opposing flanges.

* * * * *